US005505562A

United States Patent [19]

Stankus et al.

[11] Patent Number: 5,505,562

[45] Date of Patent: Apr. 9, 1996

[54] MECHANICAL TRUSS WRENCH

[75] Inventors: John C. Stankus, Canonsburg, Pa.; Jerry E. Frease, Lexington, Ky.

[73] Assignee: Jennmar Corporation, Pittsburgh, Pa.

[21] Appl. No.: 385,930

[22] Filed: Feb. 9, 1995

[51] Int. Cl.[6] ..... E21D 21/02

[52] U.S. Cl. ..... 405/259.1; 405/302.1

[58] Field of Search ..... 405/259.1, 288, 405/302.1, 302.2; 299/11

[56] References Cited

U.S. PATENT DOCUMENTS

| | | | |
|---|---|---|---|
| 1,057,230 | 3/1913 | Fleming . | |
| 2,562,973 | 8/1951 | Wicke | 81/57 |
| 2,694,953 | 11/1954 | Williams | 81/57 |
| 3,270,469 | 9/1966 | Debiton | 52/2 |
| 4,190,116 | 2/1980 | O'Neal et al. | 173/38 |
| 4,334,443 | 6/1982 | Pearson | 81/55 |
| 4,349,300 | 9/1982 | Kelley | 405/259.1 X |
| 4,351,625 | 9/1982 | Selestam et al. | 405/288 X |
| 4,395,161 | 7/1983 | Wilson et al. | 405/259.1 X |
| 4,413,538 | 11/1983 | Norman | 81/57.13 |
| 4,423,986 | 1/1984 | Skogberg | 405/259.1 X |
| 4,491,440 | 1/1985 | Baucum | 405/288 |
| 4,538,484 | 9/1985 | Hardy et al. | 81/57.14 |
| 4,573,378 | 3/1986 | McDonald | 81/463 |
| 4,592,258 | 6/1986 | Halm | 81/57.4 |
| 4,596,496 | 6/1986 | Tyrell et al. | 405/288 |
| 4,601,616 | 7/1986 | Barish et al. | 405/288 |
| 4,630,974 | 12/1986 | Sherman | 405/288 |
| 4,749,310 | 6/1988 | White | 405/259.1 X |
| 4,946,315 | 8/1990 | Chugh et al. | 405/259.1 X |
| 5,018,907 | 5/1991 | Chugh et al. | 405/288 |
| 5,026,217 | 6/1991 | Seegmiller | 405/288 |
| 5,052,496 | 10/1991 | Albert et al. | 173/29 |
| 5,193,940 | 3/1993 | Long | 405/259.1 |
| 5,238,329 | 8/1993 | Long et al. | 405/259.1 X |
| 5,302,056 | 4/1994 | Calandra, Jr. et al. | 405/288 |

*Primary Examiner*—Roger J. Schoeppel
*Attorney, Agent, or Firm*—Webb Ziesenheim Bruening Logsdon Orkin & Hanson

[57] ABSTRACT

A mechanical truss wrench for use with a mine roof bolting machine. The wrench includes a casing having a locking bracket pivotably secured to the exterior. An input shaft extends into the casing and is positioned at a right angle to an output shaft extending out of the casing. The lower end of the input shaft is secured to the torquing member of the mine roof bolting machine. In operation, a socket on the output shaft is engaged with a head of a horizontally extending torquing bolt or similar tensioning mechanism of a truss-type mine roof utilizing U-bolts. The input shaft is rotated about a vertical axis to operate a gear train to rotate the output shaft and the socket to torque the bolt. A locking member with tabs coacts with the legs of a U-bolt or similar tensioning mechanism to prevent the casing from rotating about the axis of the input shaft and a guiding member is provided to assist in guiding the torquing bolt into the socket.

28 Claims, 4 Drawing Sheets

MECHANICAL TRUSS WRENCH

BACKGROUND OF THE INVENTION

1) Field of the Invention

This invention relates generally to mine roof support trusses and, more particularly, to apparatus for installing mine roof support trusses.

2) Description of the Prior Art

Truss-type mine roof supports are well-known in the art of supporting the roof of an underground passageway, such as a passage. A basic truss system includes one or more rods extending horizontally across the width of the mine passage adjacent to the roof with the ends connected to anchor bolts which extend at an angle adjacent the ribs of the passageway into the rock strata or a solid pillar. The rods are tensioned and the resultant force produces an uplifting effect to the unsupported rock material immediately above the passageway.

With this arrangement, a truss system shifts the weight of the rock strata from over the mined out passageway back onto the pillars. Conventionally, holes are drilled into the mine roof at a 45° angle from the horizontal adjacent to the mine rib so that the holes extend into the supported rock structure of a pillar. To insure adequate anchorage over the pillar at the ribline, the bolts often extend above the supported structure of the pillar.

Once the angle holes are drilled into the strata over the pillars at the ribline, anchor bolts are inserted in the drilled holes and are secured in place using mechanical expansion shell assemblies in combination with resin. This arrangement insures adequate anchorage over the ribline for the bolts. Before the bolts are inserted in the drill holes, truss shoes or bearing blocks are positioned on the bolt at the emergent end of the bolt from the hole. As the bolts are securely anchored in the bore holes, the bearing surfaces of the truss shoes or bearing blocks are compressed into engagement with the mine roof.

Once the truss shoes or bearing blocks are securely positioned at the mine roof adjacent the ribs, the horizontal truss members are assembled and connected to the truss shoes. The truss members are tightened to a preselected torque to exert tension on the truss members which produces the resulting uplifting force applied to the roof above the mine passageway.

A wide variety of truss hardware is commercially available to form a truss system between the anchored angle bolts. The truss hardware is connected under tension to the truss shoes or bearing blocks that are held tightly against the mine roof by the anchored angle bolts.

Some of the more popular type of truss systems are disclosed in U.S. Pat. Nos. 4,596,496; 5,026,217 and 5,302,056. These truss systems include truss shoes having an arrangement that receives the closed or arcuate end of a U-bolt. This facilitates ease of assembly and disassembly of the U-bolt on the truss shoe without requiring the U-bolt to be threadedly connected to the shoe or extended through an opening in the shoe. The U-bolt is not securely connected to the truss shoe until it is placed in tension. When the connected truss members are tensioned, the U-bolts are drawn together, typically by a torquing rod or bolt, and securely retained on the truss shoes.

As presently practiced the tensioning of the torquing rods is a tedious and dangerous process, which presently is done by a miner. The miner either uses a hand-operated wrench or a hand-held wrench driven by a hydraulic pump (such as provided on a standard mine bolt bolting machine) to tension the torquing bolts. The miner must then position himself or herself directly under the U-bolt adjacent to the torquing rod nut and engages the wrench with either the head or the nut of the torquing rod, and then tensions the rod. As previously stated, this is a tedious and dangerous job. Further, if the miner is hand-tightening the torquing rods, then the miner experiences fatigue. This also occurs with a hydraulically driven wrench, since they are quite heavy and must be held and positioned by the miner during the tensioning of the torquing rods. Thus, the installation of the truss systems can become more expensive throughout a shift, since the miner will typically take longer to tension an individual torquing rod as the shift progresses.

Therefore, it is an object of our invention to overcome the expense, tedium and dangerous aspects of installing and tensioning the truss-type mine roof bolt systems.

SUMMARY OF THE INVENTION

Our invention is a wrench having an input shaft, an output shaft at a right angle to the input shaft and a socket connected thereto. The lower end of the input shaft is adapted to be received by a torquing member of a mine roof bolting machine. A plurality of gears is rotatably secured to the casing and coacts with the input shaft and the output shaft so that rotation of the input shaft causes rotation of the output shaft.

The socket is adapted to receive the end of a fastener member. A guide member is secured to the exterior of the casing and is adapted to align the socket with the end of the fastener member. A locking member can be provided to lock the wrench to a truss bracket. The wrench is used with a truss-type system including U-bolts, where tabs define spaced recesses which receive portions of the legs of the U-bolts, but can also be adapted to tighten any horizontal member of a truss system.

Our invention is also a method of using the above-described wrench in an underground passage including truss brackets, truss members and U-shaped members, whereby the wrench input shaft is secured to the torquing member of a mine roof bolting machine; the socket is positioned between the legs of the U-shaped members and is engaged with the head of a torquing bolt, activating the torquing member and tensioning a torquing bolt.

DESCRIPTION OF THE PREFERRED EMBODIMENTS

Figure 1:
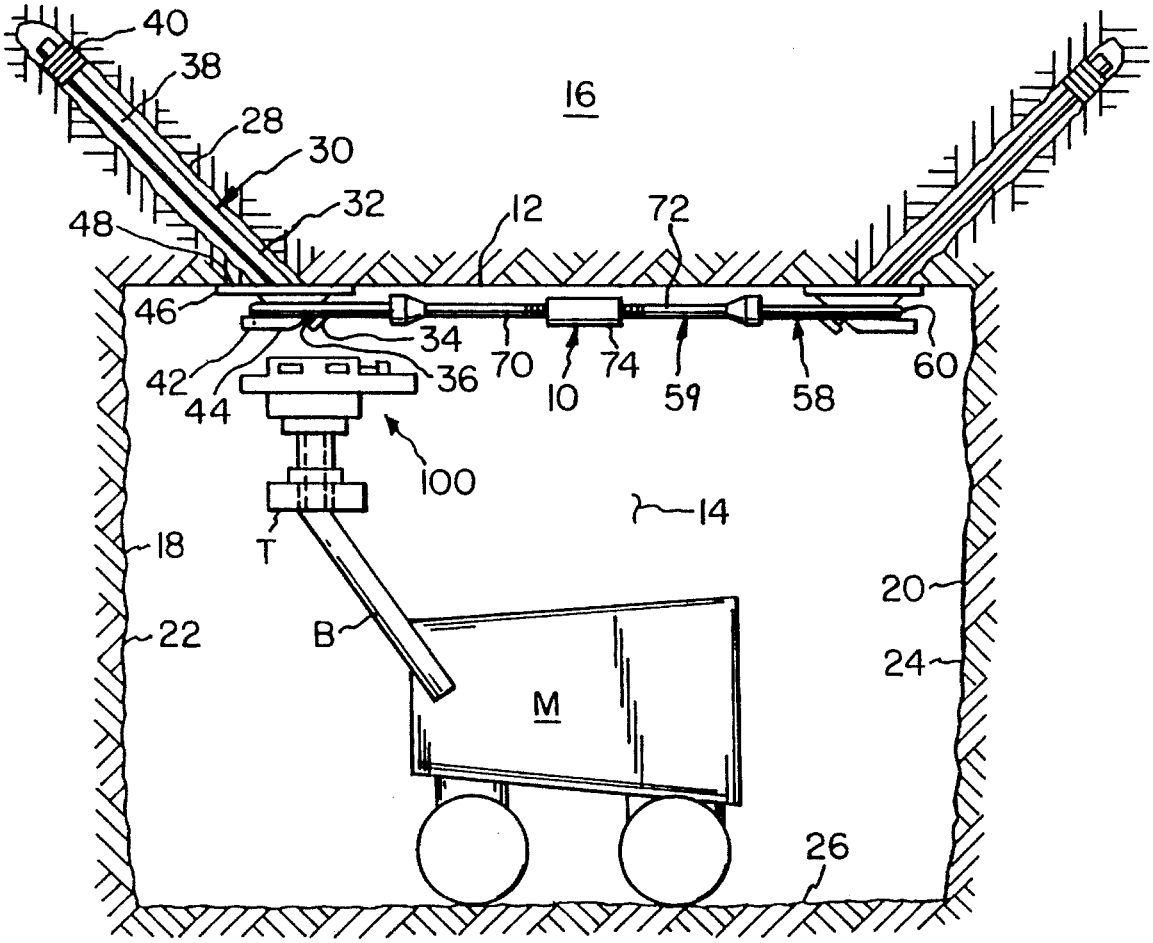
FIG. 1 is an elevation of an underground passage including a truss system, a mine roof bolting machine and a mechanical truss wrench.

FIG. 1 of the drawings shows a truss system generally designated 10 for supporting a roof 12 above an underground passageway 14 in a rock formation 16. Such a system is disclosed in detail in U.S. Pat. No. 5,302,056, which is hereby incorporated by reference. The passageway 14 is defined by oppositely positioned sidewalls and 20 formed by ribs or pillars 22 and 24 that extend between the roof 12 and the floor 26. The portion of rock formation 16 above roof 12 is unsupported.

Truss system 10 is secured to roof 12 by roof bolts inserted in angled holes in rock formation 16. A suitable roof bolt assembly 30 for use with the present invention includes elongated roof bolts 32 having an enlarged head 34 and a washer 36 at one end and a threaded end 38. A mechanical expansion shell assembly 40 is provided at end 38.

Respective roof bolt assemblies 30 hold opposed truss brackets or bearing blocks 42 in place adjacent roof 12. Each truss bracket 42 includes a unitary body 44 and a base member 46 having a bearing surface 48 for engaging mine roof 12. During assembly, each roof bolt 32 is passed through a hole in truss bracket 42 and an expansion shell assembly or other anchorage means is threaded onto end 38. The roof bolt 32 is then inserted upwardly into an angled bore hole 28 in rock formation 16 into which a resin cartridge is normally placed. The roof bolt assembly 30 is advanced into the bore hole 28 so that enlarged head 34 contacts truss bracket body 44 to urge bearing surface 48 into contact with roof 12. When bearing surface 48 is satisfactorily seated in contact with the roof, a torque is applied to the bolt head 34 to anchor the bolt assembly in the bore hole.

Each body 44 supports the closed end of a U-bolt 58. Each U-bolt 58 is connected to a tie rod assembly 59. Each U-bolt 58 includes an arcuate end portion 60 and spaced substantially parallel legs 62 and 64. A retainer 68 connects the free ends of legs 62 and 64 and is held on the legs by nuts 65 as seen in Fig.4.

In operation, each U-bolt 58 is connected to tie rod assembly 59, as set forth in detail in U.S. Pat. No. 5,302,056. Specifically, a threaded torquing bolt 70 is connected to one of the U-bolts 58 and to a tie rod 72 through a coupler 74. Tie rod 72 is connected to the other U-bolt 58. Torquing bolt 70 is tightened to a preselected torque, causing the truss brackets 42 to apply an uplifting force to the roof 12. When this preselected torque is applied to the coupler through the torquing bolt 70, the installation of truss system 10 is completed.

Heretofore, the coupler 74 was torqued manually by a hand-held wrench or by a hand-held, hydraulically-driven wrench engaged with the torquing bolt 70. Typically, the miners who install these bolts become quickly fatigued and are subject to dangerous conditions such as roof fall. The mechanical truss wrench of our invention overcomes these problems.

Figure 4:
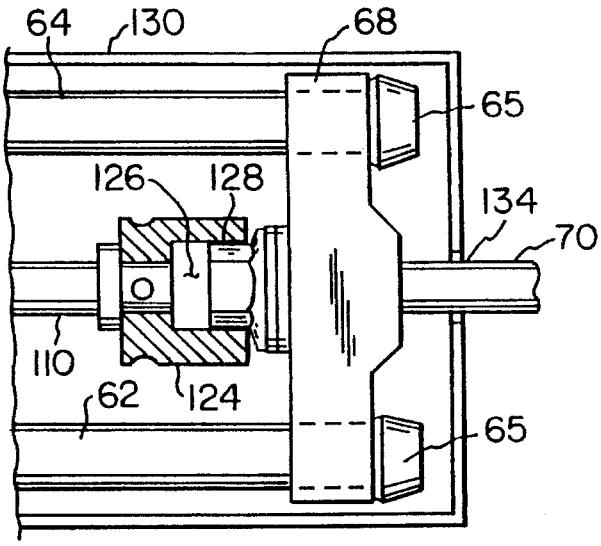
FIG. 4 is a partial section of a portion of the wrench shown in FIG. 2 engaged with a torquing bolt.
Figure 2:
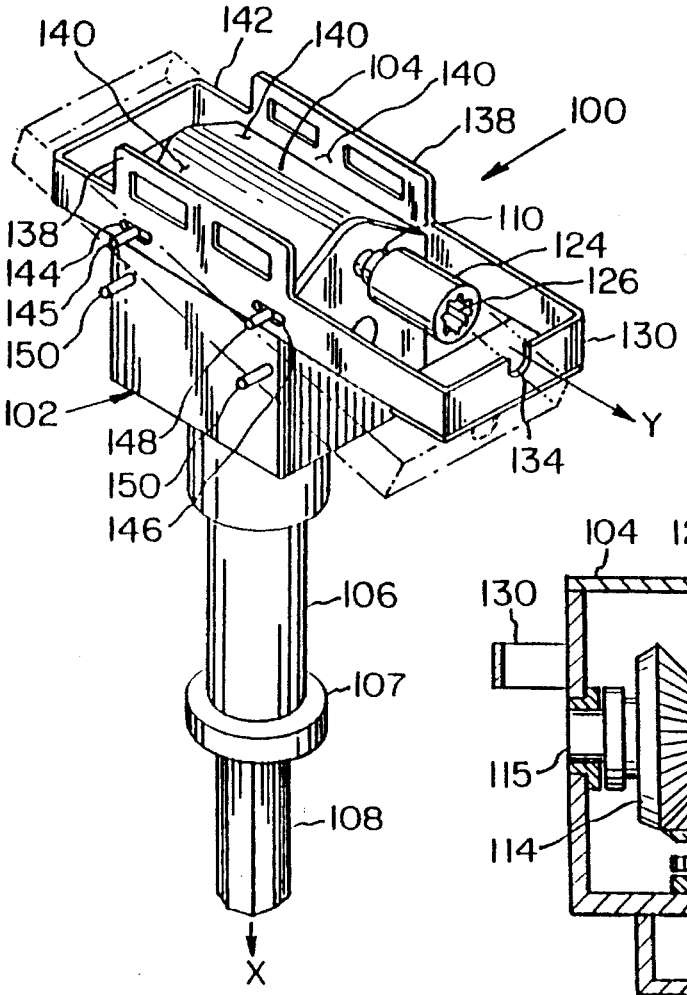
FIG. 2 is a perspective view of a first embodiment of a mechanical truss wrench.
Figure 3:
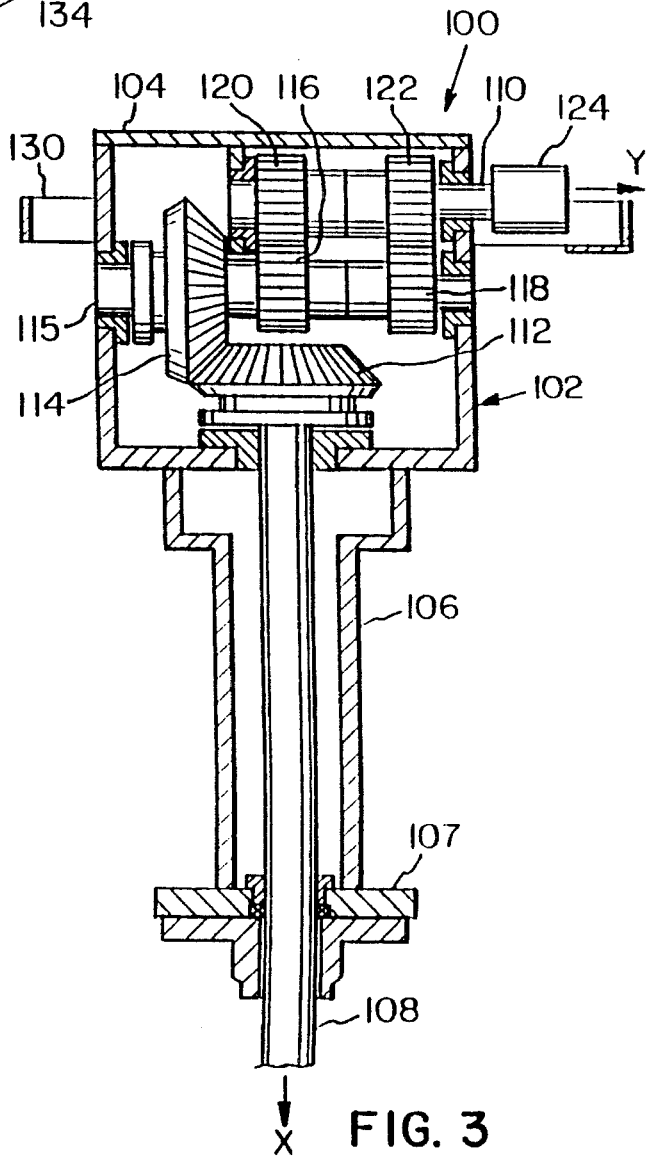
FIG. 3 is a partial vertical section of the wrench shown in FIG. 2.

A first embodiment of a mechanical truss wrench 100 in accordance with the present invention is shown in FIGS. 2–4 of the drawings. Referring to FIG. 2, wrench 100 includes a casing 102 having an upper wall 104 having sloping sides which function as guide members, as explained hereinafter. The casing includes spaced sidewalls, a front wall, a rear wall and a base plate.

A cylinder 106 extends downwardly from the base plate of casing 102. The lower end of the cylinder is secured to a bearing member 107 (shown in FIG. 3). An elongated input shaft 108 having a hexagonal or circular cross-section extends upwardly through cylinder 106 along an axis X and is coaxial with the cylinder. The lower end of the input shaft is adapted to be received by a chuck, which is a part of the torquing mechanism of a standard mine roof bolting machine for rotation. Such chucks and mine roof bolting machines are well-known in the art and such a machine M is shown in FIG. 1 of the drawings. The machine includes wheels, a body, a boom B and a rotary torquing member or mechanism T.

A horizontal output shaft 110 extends from the front of the casing along an axis Y. Preferably, the Y axis is at a right angle with respect to the X axis of the input shaft 108. Input shaft 108 coacts with the output shaft 110 through the gear arrangement shown in FIG. 3 of the drawings to translate vertical rotary motion to horizontal rotary motion. The arrangement includes a first bevelled gear 112 on input shaft 108, a second bevelled gear 114 on a shaft 115, drive gears 116 and 118 and drive gears 120 and 122, all contained within casing 102. Bevel gear 112 meshes with bevel gear 114 to drive gears 116 and 118 which, respectively, drive gears 120 and 122. Gears 114,116 and 118 are secured to shaft 115 and gears 120 and 122 are secured to drive shaft 110. Standard bearings are attached to the walls and the base of the casing for each shaft.

In operation, rotation of input shaft 108 rotates bevel gear 112 which rotates bevel gear 114 to rotate shaft 115 and drive gears 116 and 118. Drive gears 116 and 118 rotate gears 120 and 122 to rotate output shaft 110. Other types of drive arrangements can be used to transmit forces from an input shaft to an output shaft.

Referring to FIGS. 2 and 4, a socket 124 having a recess 126 with a serrated contact surface is secured to an end of output shaft 110. The surface of recess 126 is adapted to matingly engage with torquing bolt head 128 or another type of fastener member. Head 128 can be either hexagonal or square. Alternatively, recess 126 may receive a nut if a torquing bolt having a threaded shaft and a nut is used as shown in U.S. Pat. No. 4,596,496.

A locking bracket 130 is pivotably secured to the sides of casing 102. The bracket includes spaced side legs connected to rear and forward end members. The portion of locking bracket 130 located behind the forward end member is spaced from the open end of socket 124. An upwardly opening notch 134 is located at the center of the forward end member of the locking bracket and is aligned with recess 126 in socket 124 when the locking bracket is in the upper locked position. The notch 134 is adapted to receive an end portion of torquing shaft 70 near the head 128, which is received in the recess 126 in socket 124.

Locking bracket 130 includes an upwardly extending tab 138 on each side leg located adjacent to the sidewalls of casing 102. Tabs 138 are adapted to be located adjacent to the outer surfaces of U-bolt legs 62 and 64. Tabs 138 extend upwardly and define recesses 140 with the angled surfaces of top wall 104, which are adapted to receive portions of the legs of U-bolt 58. The rear member of locking bracket 130 forms a handle 142 positioned rearwardly of the rear wall of casing 102.

An elongated angled slot 144 is defined in each leg of the locking bracket near handle 142. A pivot pin 145 passes through each slot 144 and is secured to the adjacent sidewall of casing 102. An elongated angled slot 146 is also defined in each leg of the locking bracket toward the forward member. A removable pin 148 passes through each slot 146 and is secured to the adjacent sidewall of casing 102. Slots 144 and 146 have a length substantially greater than the diameter of pins 145 and 148 which permits sliding movement of locking bracket 130 relative to the casing. Stop pins 150 extend out of each sidewall of the casing below pins 145 and 148.

In operation, wrench 100 is attached to roof bolting machine M at bearing member 107 and lower end of input shaft 108 is received in a chuck, in the torquing member of roof bolting machine M for rotation thereby.

Roof bolting machine M and wrench 100 are then positioned below a U-bolt 58. The removable pins 148 are removed from the sidewalls of casing 102, causing the locking bracket 130 to pivot about an axis transverse to the Y axis of shaft 110 to raise handle 142 and lower the forward member until the lower edges of the bracket legs contact stop pins 150, as shown in phantom in FIG. 2 of the drawings. This is due to the center of gravity of locking bracket 130, which is located forwardly of pivot pins 145.

The roof bolting machine boom B is then activated to move wrench 100 in a vertical direction to position the wrench between legs 62 and 64 of U-bolt 58 so that socket 124 is positioned rearwardly of torquing bolt head 128. The wrench 100 is moved upwardly in the vertical direction until the sloped sides of the top wall 104 of casing 102 contact the surfaces of U-bolt legs 62 and 64. This aligns socket 124 with torquing bolt head 128 and notch 134 is located below retainer 68. Socket 124 is then moved forwardly along the Y axis of drive shaft 110 until recess 126 engages with torquing bolt head 128. The handle 142 is then grabbed by the miner and pulled downwardly to rotate locking bracket 130 about the transverse axis until removable pins 148 can be inserted into holes in the sidewalls of casing 102 through slots 146. The miner then inserts removable pins 148 into recesses in the sidewalls of casing 102 to secure locking bracket 130 in the locked position. The portion of the torquing bolt shaft 70 which is located adjacent retainer 68 passes through notch 134. U-bolt legs 62 and 64 are received by recesses 140 between tabs 138 and the angled top wall 104 of casing 102. The mine roof bolting machine M is then activated to rotate the torquing member so that input shaft 108 rotates output shaft 110 through the intermeshing gears to rotate socket 124.

The tabs 138 prevent casing 102 of the wrench from rotating about the axis of input shaft 108, should one of the gears lock up. In normal operation, it has been found that tabs 138 are not necessary and may be removed. The portion of the bracket that prevents the wrench 100 from pulling away from the torquing bolt head 124 may be removed or adjusted to operate with other types of truss brackets having horizontally extending tensioning members such as a torquing bolt 70.

Socket 124 rotates and tightens torquing bolt 128 (or nut, if the torquing bolt is replaced by a threaded shaft and a nut) to a preselected torque, preferably between about 150 and 175 pounds, which will be set on roof bolting machine M. After the torquing bolt is tightened, the roof bolting machine is deactivated; pins 148 are removed from the body portion 102 and locking bracket 130 pivots about the transverse axis into an unlocked position, wherein the forward end is located below the end of the torquing bolt 70. Wrench 100 is then moved rearwardly by the roof bolting machine M to disengage socket 124 from the head 128 of the torquing bolt. The boom B of roof bolting machine M is then lowered so that wrench 100 is located below the truss.

Roof bolting machine M and wrench 100 can now be moved to another location. After all of the trusses have been tightened, wrench 100 is removed from the roof bolting machine.

The above-identified wrench 100 and method of its operation enables safe and rapid installation of mine roof trusses. Additionally, it has been determined that mine roof trusses can be initially installed in a section of a mine by conventional methods except for the final tensioning of the trusses. After the trusses are installed, the torquing bolts of all of the trusses can be sequentially tightened by a wrench 100. This is an inexpensive and efficient method for installing mine roof trusses and overcomes the dangerous and tedious operation of the above-referenced prior art tightening methods. It should be noted that the wrench 100 can also be adapted to many other types of horizontal trusses and not be limited to trusses having U-bolts.

A second embodiment of a wrench 200 in accordance with the present invention is shown in FIGS. 5–9 of the drawings. Wrench 200 is similar to wrench 100 except for the below-noted differences. Like numerals are used for like parts and only the differences are discussed in detail.

Figure 5:
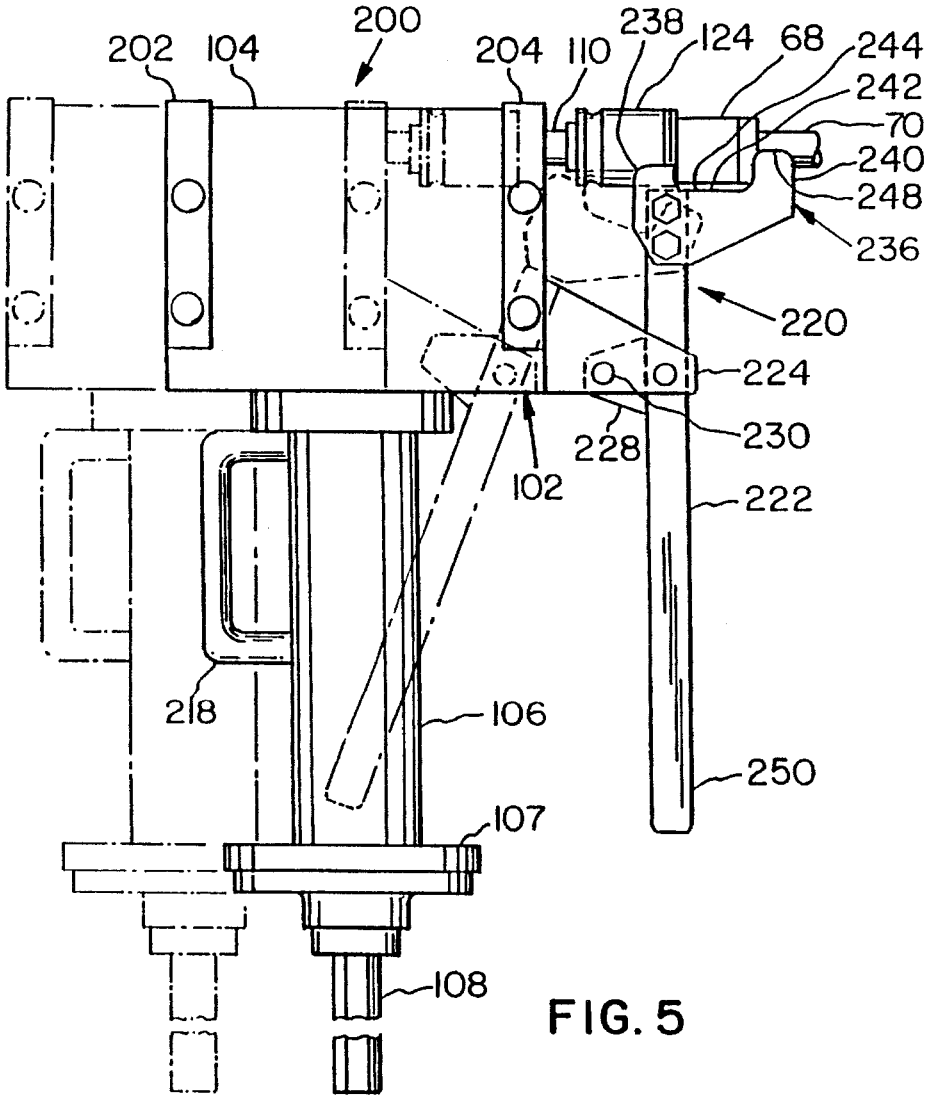
FIG. 5 is a side view of a second embodiment of a mechanical truss wrench.
Figure 6:
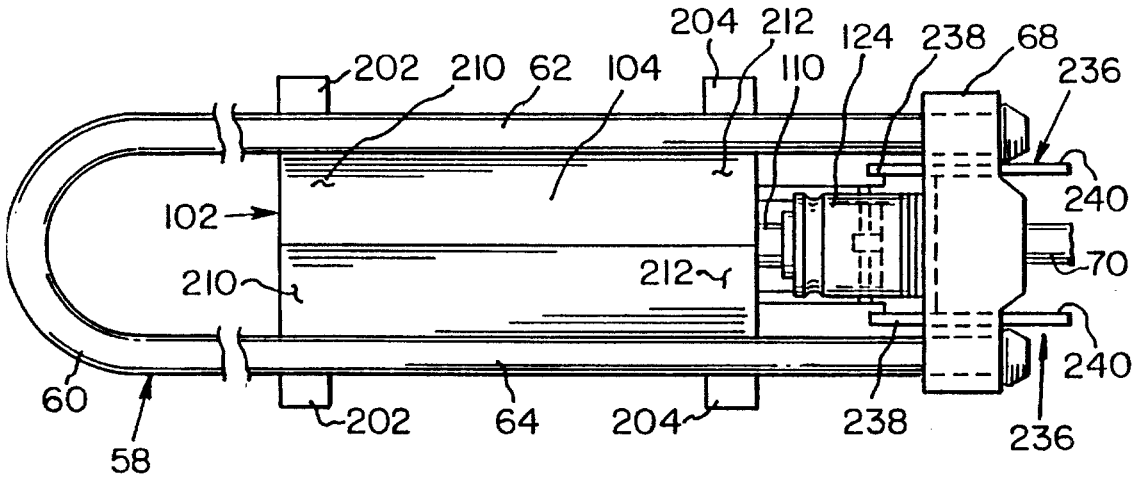
FIG. 6 is a top view of the wrench shown in Fig. 5 with a U-bolt.
Figure 8:
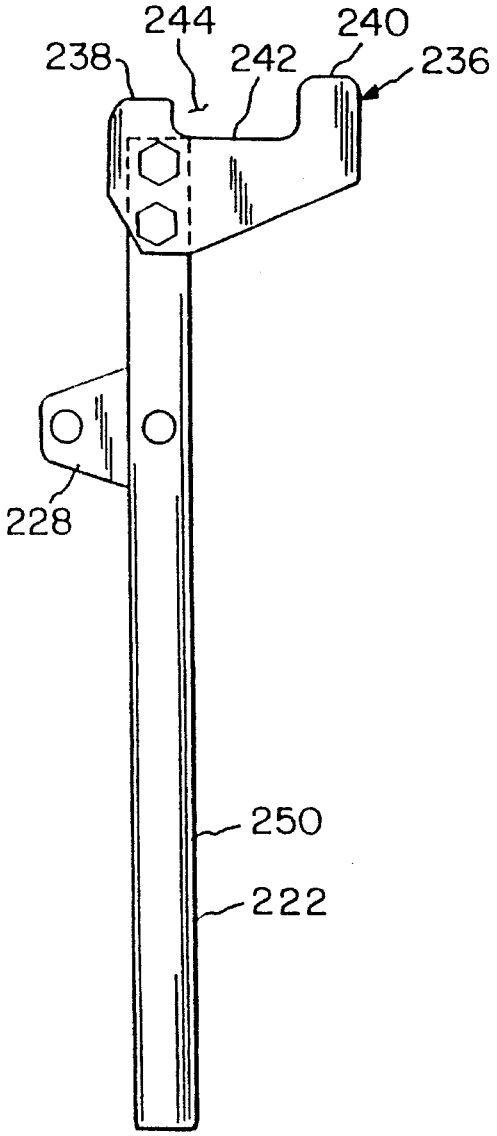
FIG. 8 is a side view of the locking member of the wrench shown in FIG. 7.
Figure 7:
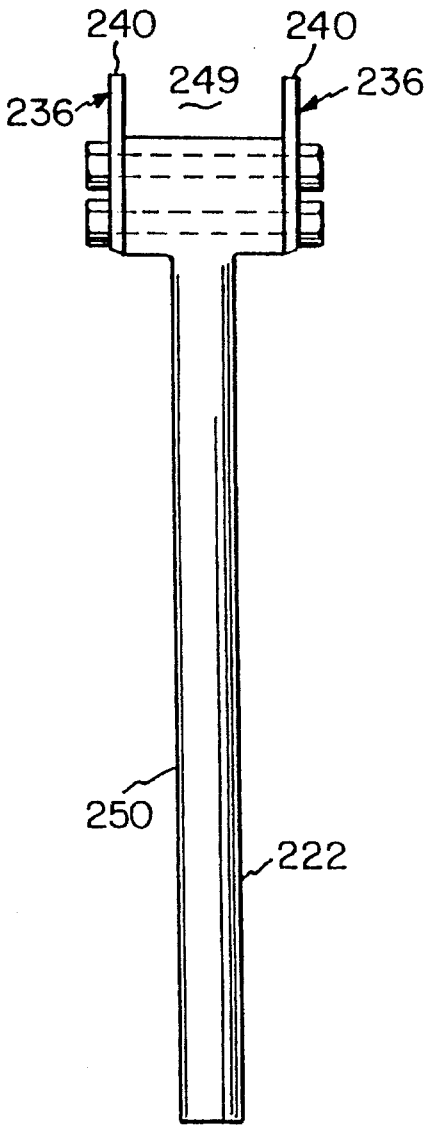
FIG. 7 is a front view of the locking member of the wrench shown in FIG. 5.
Figure 9:
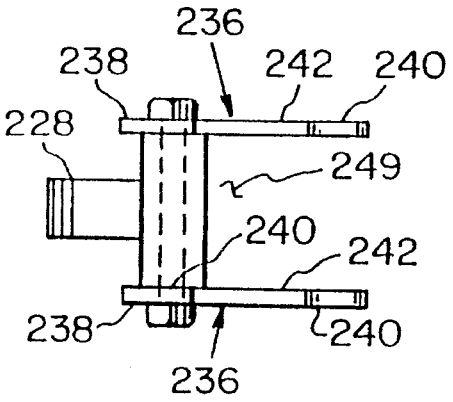
FIG. 9 is a top view of the locking member shown in FIGS. 7 and 8.

Tabs 138 of the wrench 100 have been replaced by longitudinally spaced tabs 202 and 204 as shown in FIGS. 5 and 6 of the drawings. Fasteners removably fasten tabs 202 and 204 to the opposite sidewalls of the casing and the tabs extend upwardly adjacent the sloped surfaces of the top wall of the casing to define recesses 210 and 212. Recesses 210 and 212 are adapted to receive a portion of the legs of U-bolt 58. Preferably, the tab fasteners are screws that can be easily removed when the tabs are to be removed. A handle 218 is secured to the outer surface of casing 106. Handle 218 permits easy handling of the wrench when it is not secured to a mine roof bolting machine.

In lieu of locking bracket 130, wrench 200 includes a locking arrangement 220. As shown in FIGS. 5 and 7–9, locking arrangement 220 includes an elongated member 222 pivotably secured to the front wall of casing 102 by spaced lugs 224. A pivot pin passes through a hole in member 222 and its ends are located in holes in lugs 224 so that member 222 can rotate about an axis which is transverse to axis Y of the drive shaft and axis X of the output shaft. Coaxial holes are also defined at the mid-section of lugs 224. A lug 228 having a hole is welded to the middle portion of member 222 and is located between lugs 224. Lug 228 is positioned so that the hole is aligned with holes in lugs 224 to receive a removable locking pin 230.

Spaced lugs 236 are secured to the opposite sides of the upper end of member 222 by fasteners such as screws. Each lug 236 includes a first upwardly extending finger 238 and a second upwardly extending finger 240. A base section having an upper edge 242 separates first finger 238 from second finger 240. Finger 240 is longer than finger 238. Fingers 238 and 240 and the base section 242 define an open-ended, upwardly opening recess 244 for receiving member 68 on U-bolt 58.

Wrench 200 is secured to roof bolting machine M in the same manner as described for wrench 100. Locking pin 230 is removed from lugs 228 and lugs 224, which causes member 222 to rotate about the pivot pin to lower the lugs 236 so that the first finger 238 is located in a horizontal plane above a plane including second finger 240 in an unlocked position (as shown in phantom lines in FIG. 5 of the drawings). Roof bolting machine M is then activated so that boom B moves wrench 200 to locate the angled upper wall 104 of casing 102 between legs 62 and 64 of U-bolt 58. At this point, socket 124 is positioned rearwardly and away from torquing bolt lead 128. The wrench 200 is moved upwardly in the vertical direction until sloped upper wall 104 contacts the inner surfaces of legs 62 and 64 to position socket 124. In this position, the upper portions of fingers 238 extend above a lower portion of holder 68 and fingers 240 are positioned below holder 68 (as shown in phantom in FIG. 5 of the drawings). The socket is then moved forwardly guided by legs 62 and 64 and the sloped upper wall 104 of the casing until it engages with torquing bolt head 128 as previously described. Moving the wrench 200 causes fingers 238 to contact a surface of member 68. Continued movement causes member 222 to pivot so that fingers 240 pivot in an upwardly direction until they are adjacent to a rearward surface of member 68, thereby locking the locking member in a locked position. A passageway 249 is defined between fingers 240 through which the torquing bolt passes. Holes in lugs 224 and lugs 228 are aligned and locking pin 230 is passed therethrough, thereby securing the locking arrangement 220 in place. Legs 62 and 64 of U-bolt 58 are received within recesses 210 and 212 as shown in FIG. 6 of the drawings.

Roof bolting machine M is then activated so that rotational torque is applied to the socket 124, thereby torquing the torquing bolt 70 as previously described. Like tabs 138, tabs 202 and 204 prevent wrench casing 102 from rotating if the gears lock up. In normal operation of wrench 200, the tabs 202 and 204 can be removed.

After the torquing bolt is sufficiently torqued, locking pin 230 is removed and the roof bolt machine M is moved in a rearwardly direction, or the miner can first grasp a lower handle portion 250 of the member 222 and rotate it about lugs 224. This causes fingers 240 to be positioned below member 68 so that locking arrangement 220 is in an unlocked position. The mine roof bolting machine M is then moved rearwardly to disengage the socket 124, as previously discussed.. Wrench 200 is then lowered and either moved to another site or removed from the roof bolting machine M.

In the foregoing specification, we have described the presently preferred embodiments of our invention and method of practicing the invention. However, it will be understood that the invention can be otherwise embodied and practiced within the scope of the appended claims.

We claim:

1. A wrench for use in a mine comprising:

a casing;

a first shaft extending along a first longitudinal axis rotatably secured to said casing, said first shaft having an end adapted to be received by a torquing member on a mine roof bolting machine;

a second shaft extending along a second longitudinal axis located at a right angle to said first shaft rotatably secured within said casing;

a plurality of gears rotatably secured to said casing and coacting with each other, with said first shaft and with said second shaft so that when said first shaft is rotated about said first longitudinal axis, said gears coact with each other and cause said second shaft to rotate about said second longitudinal axis;

a socket secured to the distal end of said second shaft adapted to receive a fastener member; and a guide member secured to the exterior of said casing and adapted to align said socket with a fastener member.

2. A wrench as defined in claim 1 wherein said guide member is adapted to receive the legs of a U-shaped bolt.

3. A wrench as defined in claim 2 wherein said casing has an upper wall with sloped sides and said guide member includes portions of said sloped walls which are adapted to contact the legs of a U-bolt to align said socket with the fastener member.

4. A wrench for use in a mine as claimed in claim 1 further comprising a locking member and means on said locking member defining a passageway through which the fastener member is adapted to be located.

5. A wrench for use in a mine as claimed in claim 4 wherein said locking member is spaced from said casing and from said socket.

6. A wrench for use in a mine as claimed in claim 1 further comprising two spaced apart tabs secured to opposite sides of said casing, said tabs and said guide member defining recesses adapted to receive the legs of a U-bolt.

7. A wrench for use in a mine as claimed in claim 6 wherein a locking member is attached to said tabs, said locking member defining a notch for receiving the fastener member and spaced apart from said casing and said socket, said locking member and said tabs pivotably secured to said casing.

8. A wrench adapted to be attached to a torquing member of a mine roof bolting machine for use in a mine having a truss type support system including U-bolts and U-bolt holders, comprising:

a casing;

a first shaft extending along a first longitudinal axis rotatably secured to said casing and having an end adapted to be received in the torquing member of a mine roof bolting machine;

a second shaft extending along a second longitudinal axis rotatably secured to said casing and located at a right angle to said first shaft;

a plurality of gears rotatably secured to said casing and coacting with each other, with said first shaft and with said second shaft so that when said first shaft is rotated about said first longitudinal axis, said gears coact with each other and cause said second shaft to rotate about said second longitudinal axis; and a socket on an end of said second shaft adapted to receive one of a bolt head and a nut of a torquing bolt, whereby rotation of said first shaft rotates said second shaft and said socket to rotate an element contained in said socket.

9. A wrench for use in a mine as claimed in claim 8 further comprising a locking member defining a notch through which a shaft of the torquing bolt is adapted to pass, said second longitudinal axis passing through said notch.

10. A wrench for use in a mine as claimed in claim 8 further comprising a locking member secured to said casing and spaced apart from said socket, whereby said locking member and said socket are adapted to position a U-bolt holder between said locking member and said socket, thereby locking said wrench to a truss.

11. A wrench for use in a mine as claimed in claim 8 further comprising at least two tabs secured to opposite sides of said casing and defining recesses with said casing adapted to receive the legs of a U-bolt.

12. A wrench for use in a mine set forth in claim 8 further comprising a handle secured to said casing.

13. A wrench for use in a mine as claimed in claim 11 including means for removably attaching said tabs to said casing.

14. A wrench for use in a mine as claimed in claim 8 further comprising a locking member having a finger arrangement adapted to receive a member in a U-shaped bolt connector of a truss support system.

15. A wrench for use in a mine as claimed in claim 14 wherein said finger arrangement comprises two spaced apart fingers attached to a base section, forming a first finger plate, wherein the member is adapted to be positioned between said fingers.

16. A wrench for use in a mine as claimed in claim 14 wherein said finger arrangement is pivotably secured to said casing so that said first finger arrangement can pivot between an unlocked position and a locked position, whereby when said finger arrangement is in the locked position, said socket is adapted to engage with the fastening member.

17. A wrench for use in a mine as claimed in claim 16 further comprising a second finger arrangement similar to said first finger arrangement and including two spaced apart second fingers attached to a second base section, said second finger arrangement longitudinally spaced apart from said first finger arrangement.

18. A wrench for use in a mine as claimed in claim 16 wherein said locking member includes a removable pin adapted to be received by said locking member to maintain said finger arrangement in the locked position.

19. A wrench for use in a mine as claimed in claim 16 further comprising a handle member attached to said first finger arrangement, whereby a miner can pivot said first finger arrangement between a locked position and an unlocked position.

20. A method for supporting a roof of an underground passage, with a truss, comprising the steps of:

securing a pair of truss brackets to the roof of the underground passage;

positioning a truss member between said pair of truss brackets, the truss member including a torquing bolt having one of a nut and a bolt head;

extending a U-shaped member from each end of the truss member toward a truss bracket, each of the U-shaped members including a pair of spaced substantially parallel legs;

securing said U-shaped members to the truss member, so that one of the head and the nut of the torquing bolt is received between the legs of one of the U-shaped members, the U-shaped members and the torquing bolt extending substantially horizontally;

securing the lower end of a vertically extending input shaft of a right angled wrench to the torquing member of a mine roof bolting machine, said right angle wrench having a horizontally extending output shaft with a socket;

engaging said socket with the one of the head and the nut;

activating said mine roof bolting machine to rotate said torquing member and said vertically extending input shaft about a vertical axis to cause said socket and said one of said nut and said head to rotate about a horizontal axis; and tensioning the torquing bolt secured to the truss bracket.

21. A method for supporting the roof of an underground passage as claimed in claim 20 wherein a guide is secured to said wrench, said method further comprising the step of:

positioning said guide with said truss so that said socket is guided onto the one of the head and the nut.

22. A method for supporting the roof of an underground mine as claimed in claim 20, said method further comprising the step of locking said wrench to said truss.

23. A method for supporting the roof of an underground mine as claimed in claim 20, said method further comprising receiving the legs of the U-bolt in recesses defined by said wrench to prevent rotation of said wrench casing.

24. A wrench for use in a mine comprising:

a casing;

a first shaft extending along a first longitudinal axis rotatably secured to said casing, said first shaft having an end adapted to be received by a torquing member on a mine roof bolting machine;

a second shaft extending along a second longitudinal axis located at a right angle to said first shaft rotatably secured within said casing;

a plurality of gears rotatably secured to said casing and coacting with each other, with said first shaft and with said second shaft so that when said first shaft is rotated about said first longitudinal axis, said gears coact with each other and cause said second shaft to rotate about said second longitudinal axis; and a socket secured to the distal end of said second shaft adapted to receive a fastener member.

25. A method for supporting a roof of an underground passage, with a truss, comprising the steps of:

securing a pair of truss brackets to the roof of the underground passage;

securing a truss member to said pair of truss brackets in the horizontal direction, the truss member including a torquing bolt having one of a nut and a bolt head;

securing the lower end of a vertically extending input shaft of a right angled wrench to the torquing member of a mine roof bolting machine, said right angle wrench having a horizontally extending output shaft with a socket;

engaging said socket with the one of the head and the nut;

activating said mine roof bolting machine to rotate said torquing member and said vertically extending input shaft about a vertical axis to cause said socket and said one of said nut and said head to rotate about a horizontal axis; and tensioning the torquing bolt secured to the truss bracket.

26. A wrench adapted to be attached to a torquing member of a mine roof bolting machine for use in a mine having a truss type support system including a horizontally extending tensioning member, comprising:

a casing;

a first shaft extending along a first longitudinal axis rotatably secured to said casing and having an end adapted to be received in the torquing member of a mine roof bolting machine;

a second shaft extending along a second longitudinal axis rotatably secured to said casing and located at a right angle to said first shaft;

a plurality of gears rotatably secured to said casing and coacting with each other, with said first shaft and with said second shaft so that when said first shaft is rotated about said first longitudinal axis, said gears coact with each other and cause said second shaft to rotate about said second longitudinal axis; and a socket on an end of said second shaft adapted to receive one of a bolt head and a nut of the tensioning member, whereby rotation of said first shaft rotates said second shaft and said socket to rotate an element contained in said socket.

27. A wrench for use in a mine as claimed in claim 26 further comprising a locking member secured to said casing and spaced apart from said socket, whereby said locking member and said socket are adapted to position a portion of the truss type support system between said locking member and said socket, thereby locking said wrench to a truss.

28. In a method for supporting a mine roof by installing a truss system having a horizontally disposed threadable member, comprising:

providing a wrench having a vertically extending input shaft and a horizontally extending output shaft;

securing a lower end of said vertically extending input shaft to a torquing member of a mine roof bolting machine;

engaging a socket attached to said output shaft to said horizontally disposed threadable member; and activating said bolting machine to install said truss system.

* * * * *